US008931239B2

(12) United States Patent
Evers

(10) Patent No.: US 8,931,239 B2
(45) Date of Patent: Jan. 13, 2015

(54) TRANSPORT SECTION FOR CONVEYING CAPS OR SIMILAR CLOSURES FOR CLOSING BOTTLES OR SIMILAR CONTAINERS

(75) Inventor: Hartmut Evers, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 449 days.

(21) Appl. No.: 12/996,267

(22) PCT Filed: Jun. 17, 2009

(86) PCT No.: PCT/EP2009/004340

§ 371 (c)(1),
(2), (4) Date: Dec. 3, 2010

(87) PCT Pub. No.: WO2010/012334

PCT Pub. Date: Feb. 4, 2010

(65) Prior Publication Data

US 2011/0138740 A1 Jun. 16, 2011

(30) Foreign Application Priority Data

Jul. 31, 2008 (DE) ..... 10 2008 035 605

(51) Int. Cl.

| | |
|---|---|
| ***B67B 1/03*** | (2006.01) |
| ***B65B 63/08*** | (2006.01) |
| ***B67B 3/06*** | (2006.01) |
| ***B67B 3/00*** | (2006.01) |

(52) U.S. Cl.

CPC ..... *B67B 3/003* (2013.01)
USPC ..... 53/306; 53/127; 53/290

(58) Field of Classification Search

CPC ..... A61L 2202/23; B67B 5/036; B67B 3/003
USPC ..... 53/167, 306, 285, 432, 127, 290
See application file for complete search history.

(56) References Cited

U.S. PATENT DOCUMENTS

| | | | | |
|---|---|---|---|---|
| 2,779,358 | A * | 1/1957 | Fechheimer et al. | 141/92 |
| 2,931,147 | A * | 4/1960 | Barnby | 53/432 |
| 3,833,339 | A * | 9/1974 | Pacilio | 422/105 |
| 3,861,118 | A * | 1/1975 | Muto | 53/167 |
| 3,908,341 | A * | 9/1975 | Conti | 53/314 |

(Continued)

FOREIGN PATENT DOCUMENTS

| | | |
|---|---|---|
| DE | 30 09 202 | 9/1981 |
| DE | 297 08 145 | 12/1997 |

(Continued)

*Primary Examiner* — Gloria R Weeks
(74) *Attorney, Agent, or Firm* — Occhiuti & Rohlicek LLP

(57) ABSTRACT

On a transport or conveyor section for conveying caps or similar closures (2) for bottles or similar containers, and for treating the closures with a treatment medium, for example with at least one sterilization medium, the at least one treatment medium is used at the same time for conveying the closures along the conveyor or transport section (1, 1*a*).

20 Claims, 5 Drawing Sheets

(56) References Cited

U.S. PATENT DOCUMENTS

| | | | | |
|---|---|---|---|---|
| 4,716,708 | A * | 1/1988 | Ochs | 53/314 |
| 5,857,309 | A | 1/1999 | Cicha | |
| 6,341,472 | B1 * | 1/2002 | Schroeder | 53/426 |
| 6,442,915 | B1 * | 9/2002 | Kurth et al. | 53/426 |
| 6,457,299 | B1 * | 10/2002 | Schwenke et al. | 53/510 |
| 6,484,477 | B1 * | 11/2002 | Bernhard | 53/426 |
| 7,040,075 | B2 * | 5/2006 | Seebeger et al. | 53/432 |
| 7,412,811 | B2 * | 8/2008 | Marcus et al. | 53/432 |
| 7,536,839 | B2 * | 5/2009 | Kemper et al. | 53/426 |
| 2005/0247028 | A1 * | 11/2005 | Topf | 53/167 |
| 2007/0006550 | A1 * | 1/2007 | Kemper et al. | 53/426 |
| 2010/0218456 | A1 * | 9/2010 | Skarin et al. | 53/133.3 |
| 2011/0016829 | A1 * | 1/2011 | Drenguis et al. | 53/426 |

FOREIGN PATENT DOCUMENTS

| | | |
|---|---|---|
| DE | 101 45 102 | 4/2003 |
| DE | 103 593 92 | 5/2005 |
| EP | 1547622 | 6/2005 |
| EP | 1 803 681 | 7/2007 |
| WO | 87/06170 | 10/1987 |

* cited by examiner

TRANSPORT SECTION FOR CONVEYING CAPS OR SIMILAR CLOSURES FOR CLOSING BOTTLES OR SIMILAR CONTAINERS

CROSS-REFERENCE TO RELATED APPLICATIONS

This application is the National Stage of International Application No. PCT/EP2009/004340, filed on Jun. 17, 2009, which claims the benefit of German Application Serial No. 10 2008 035 605.0, filed on Jul. 31, 2008. The contents of both of the foregoing applications are hereby incorporated by reference in their entirety.

The invention relates to a transport section according to the preamble of claim 1.

BACKGROUND OF THE INVENTION

There are many different designs of transport sections known, in particular for supplying closures from a supply unit, which, among other things, has a hopper for accommodating a plurality of closures as a random quantity, to a closure transfer of a closing machine. In this case, the provision of a plurality of treatment stations at the transport section is also known in particular (DE 101 45 102 A1), the closures being sterilized in said treatment stations before they reach the closure transfer of the closing machine. In the case of said known device, the closures or caps introduced into a conveying channel are pushed by a conveying element, formed by a cap wheel, through the conveying channel closely adjoining one another in a one-lane cap or closure flow and are moved past the treatment stations that are in the form of nozzle assemblies. Disadvantages here, among others, are the relatively low output (number of treated or sterilized closures per unit time) and the risk of the closures jamming in the conveying channel.

Also known is a device for sterilizing closures (DE 103 59 392 B3), where the closures are moved by means of a plurality of levels, formed in each case by a rotatingly driven disc, and by means of inclined planes that interconnect the levels from the top to the bottom, through a treatment chamber that is impinged upon with a disinfecting or sterilizing medium. Said known device is structurally expensive, requires a relatively large structural shape and, over and above this, is greatly limited as regards possible sterilizing methods.

BRIEF SUMMARY OF THE INVENTION

It is the object of the invention to provide a transport section which, with a simplified structural embodiment, ensures improved conveying, at the same time however also ensuring improved treatment of the closures with a fault-free method of operation. This object is achieved by a transport section corresponding to claim 1. The transport section according to the invention is a conveying section and also a treatment section for conveying and treating, in particular for conveying and sterilizing the closures.

The closures are conveyed in a pneumatic or hydraulic manner at least on a part, and in this case preferably on the larger part, of the transport section, i.e. by using a gaseous and/or vaporous medium or by using a liquid medium, which, at least on a part length of the transport section or at least at one treatment station formed by said part length and/or at least at one treatment station formed at the transport section, is then formed by at least one sterilizing medium for sterilizing or disinfecting the closures.

Outside the at least one treatment zone or treatment station, the closures are also transported, insofar as not by gravitational force, by means of a hydraulic or pneumatic medium, for example by means of a sterile gaseous and/or vaporous or liquid medium, e.g. by means of sterile air.

The embodiment according to the invention not only simplifies the transport of the closures along the transport section, but in particular also intensifies the treatment of the closures in a considerable manner with the at least one sterilizing medium, in that said sterilizing medium effects the transport of the closures or at least contributes in a considerable manner to the transport of the closures and thereby inevitably works on the closures, in particular also in such a manner that the closures are rotated or rolled along guide surfaces of the transport section or of a closure channel, consequently ensuring an effect of the sterilizing medium on all regions of the outside and inside surfaces of the closure.

Further developments, advantages and application possibilities of the invention are produced from the following description of exemplary embodiments and from the Figures. In this case all features described and/or graphically represented, individually or in arbitrary combination, are in principle objects of the invention, irrespective of their summary in the claims or their dependency. The content of the claims is also made a component part of the description.

BRIEF DESCRIPTION OF THE SEVERAL VIEWS OF THE DRAWING(S)

The invention is described below by way of the Figures of exemplary embodiments, in which, in detail:

Figure 4:
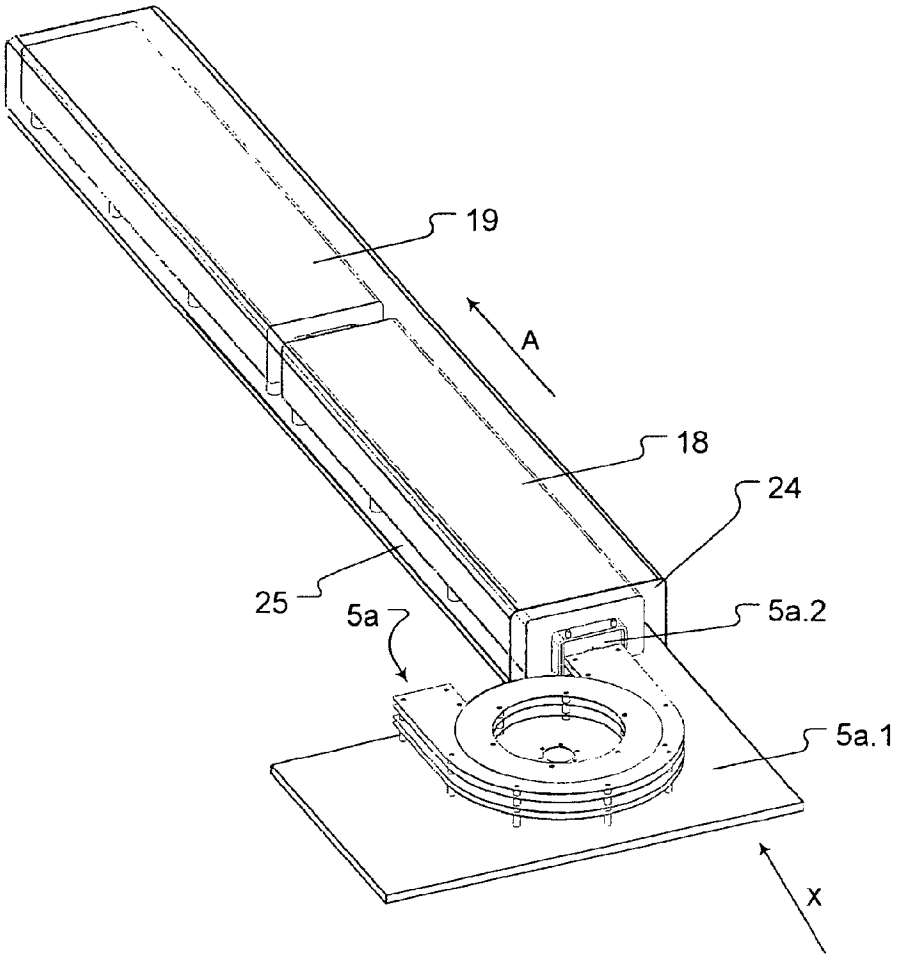
FIG. 4 shows a simplified representation in perspective of a part length of a transport section, together with two treatment stations provided at said transport section.
Figure 5:
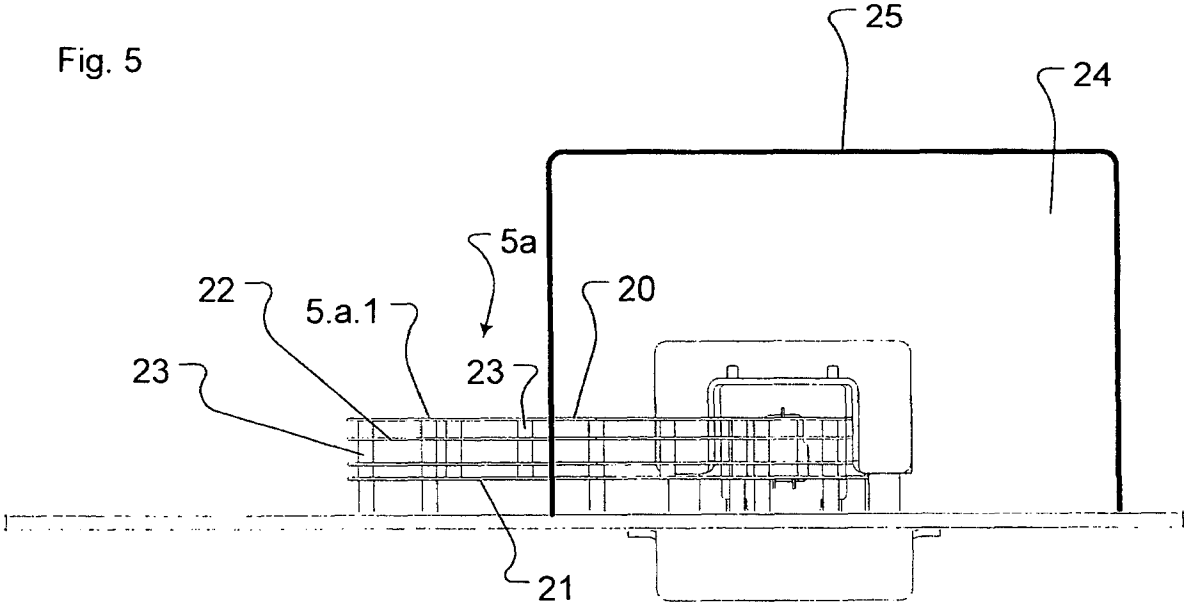
FIG. 5 shows a simplified representation of a view onto the transport section in FIG. 5 in the viewing direction of arrow X in FIG. 4.
Figure 6:
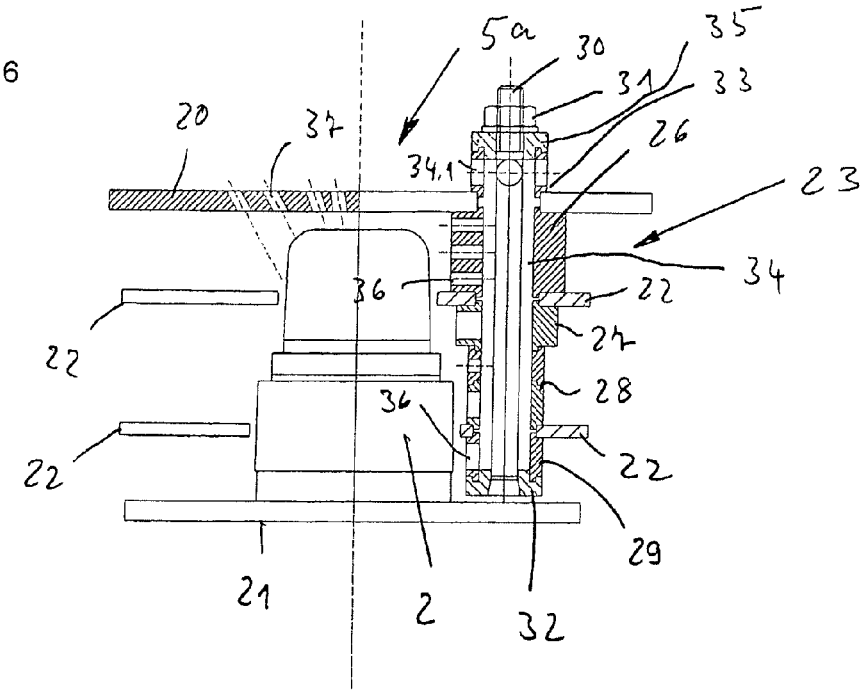
Figure 7:
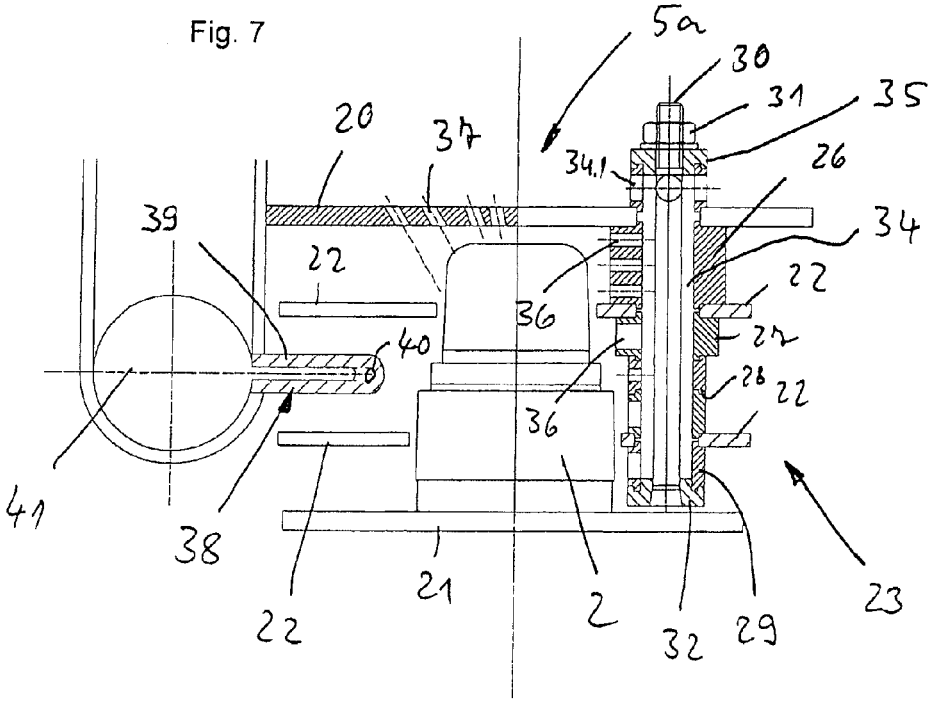

FIGS. 6 and 7 each show sections through a closure channel, for example through a portion, realized as a curve, of the closure channel of the transport section in FIGS. 4 and 5.

DETAILED DESCRIPTION OF THE INVENTION

Figure 1:
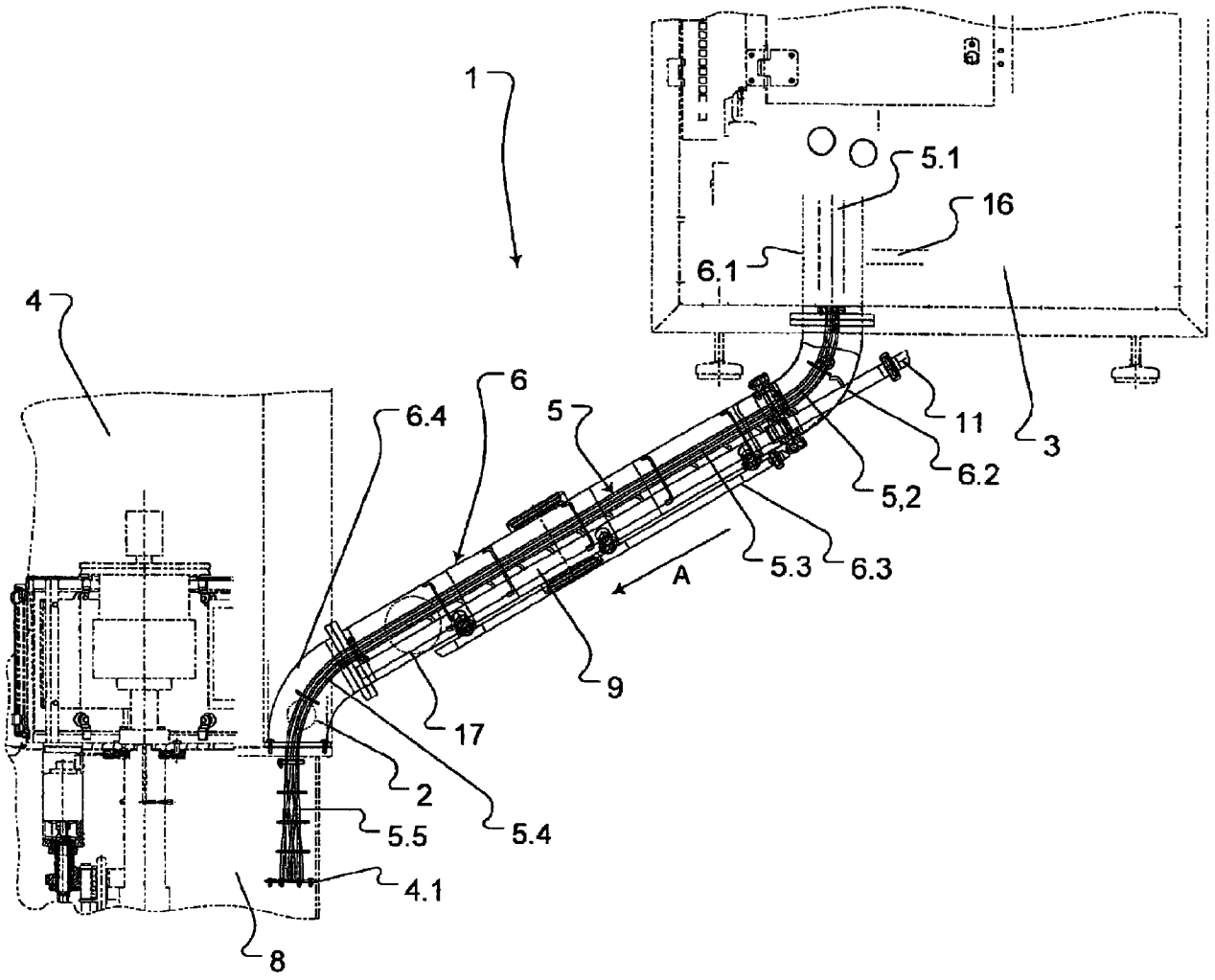
FIG. 1 shows a simplified representation of a transport section for caps or similar closures between a supply unit and a closing machine.
Figures 2, 3:
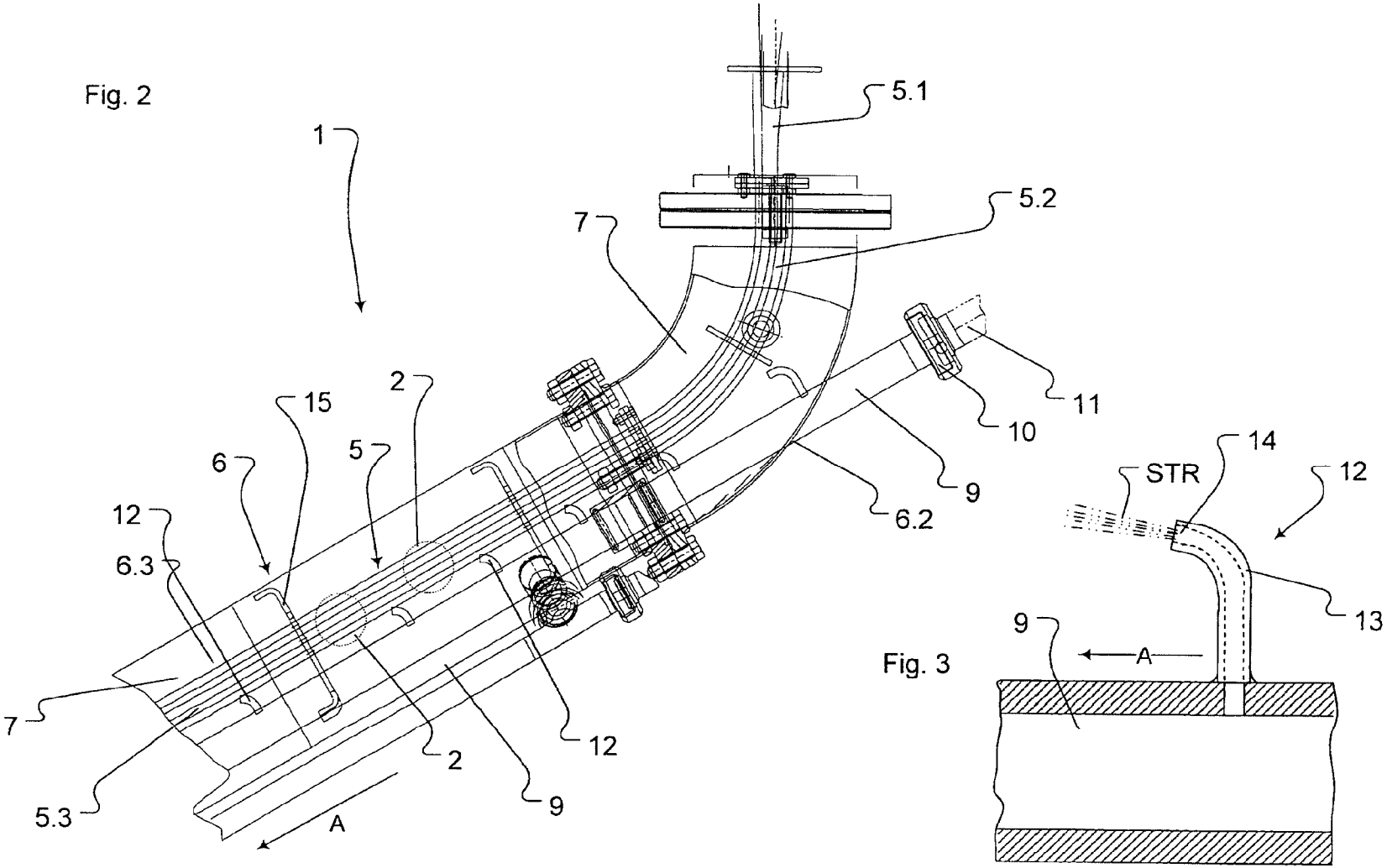
FIG. 2 shows an enlarged partial representation of the transport section in FIG. 1.
FIG. 3 shows a nozzle for treating and transporting the closures.

The reference 1 is given in FIGS. 1 and 2 to a transport section for supplying caps 2 or other closures from a supply unit 3 to a closing machine 4 for closing bottles (not represented) or similar containers by means of caps 2. The embodiments of the supply unit 3 as well as of the closing machine 4 are known to the expert. The supply unit 3 is realized accordingly with a hopper for accommodating a plurality of caps 2 as well as with a sorting device, by means of which the caps 2 are transferred, in each case one after the other in a single-lane cap flow, to a cage-like cap channel 5 of the transport section 1, which extends inside an interior 7, closed to the outside, of a, for example, pipe-like housing 6 of the transport section 1.

The cap channel 5 forms an inlet in the region of the supply unit 3 or at the sorting unit at that location and an outlet in the region of the closing machine 4 or at a cap transfer 4.1 at that location. Proceeding from the supply unit 3, the cap channel 5 first of all has a straight portion 5.1 that extends downwards in the vertical direction, connecting thereto an arc-shaped curved portion 5.2, connecting thereto a straight portion 5.3 that extends inclinedly downwards, connecting thereto an arc-shaped curved portion 5.4 and connecting thereto a section 5.5, which ends at the cap transfer, extends in straight line downwards and is realized in a sterile chamber 8 of the closing machine 5.

Following the course of the cap channel 5, the pipe-shaped housing 6, proceeding from the supply unit 3, also forms a straight portion 6.1 that extends vertically downwards, a curved portion 6.2 connecting thereto, a straight housing portion 6.3 that extends inclinedly downwards connecting thereto and connecting thereto an arc-shaped curved housing portion 6.4, which opens out into the sterile chamber 8 of the closing machine 4 that is sealed towards the surrounding area. The cap channel 5 is realized such that the caps 2 can be conveyed therein, with a certain amount of play and a low level of friction, in the conveying direction A from the supply unit 3 to the closing machine 4.

A distributor pipe 9 is provided in the housing interior 7 in the region of the housing portion 6.3, at a spacing below the portion 5.3 of the cap channel 5. The distributor pipe 9, which extends by way of its bottom end as far as approximately to the transition between the housing portions 6.3 and 6.4 and is closed at said end, is guided by way of its top end in the region of the housing portion 6.2 in a sealed manner out of the housing interior 7 and is provided with a coupling piece 10, for connecting to a line 11 for the controlled supplying of a pressurized gaseous and/or vaporous sterilizing medium.

The nozzles 12, which are provided distributed at a spacing one from another in the longitudinal direction of the distributor channel 9, are each produced, in the embodiment represented, from a pipe section 13, which stands out in a radial manner at the top side of the distributor pipe 9 facing the cap channel 5 and is curved in the conveying direction A at its free end forming a nozzle opening 14, such that through the jets STR of the vaporous and/or gaseous sterilizing medium or disinfecting medium that emerges from the nozzle openings 14 and also fills out the entire housing interior, not only are the caps 2 sterilized or disinfected in a necessary manner over their entire surfaces, but also said caps 2 at the same time undergo a conveying movement in the conveying direction A. The caps 2, therefore initially under the effect of gravitational force, pass via the portion 5.1 into the curved portion 5.2 and from there are moved further in the conveying direction A, without the constraints of a mechanical transport element, by means of the sterilizing medium or disinfecting medium emerging from the nozzles 12, passing as far as the portion 5.4, from which the caps 2, again under the effect of gravity, pass via the portion 5.5 to the cap or closure removing means 4.1.

In order to achieve reliable, high quality sterilization of the caps with at the same time the closing machine 4 having a high output, i.e. a high number of containers or bottles closed per unit time and consequently a high number of caps 2 supplied to the closing machine 4 per unit time, the length of the transport section 1 or rather of the housing portion 6.3 that is mostly used for sterilizing the caps 2 is sufficiently long, for example is 2-5 m in length.

The sterilizing medium is supplied under pressure, preferably in a pulsed manner, and so the conveying speed of the caps 2 along the cap channel 5, and consequently the exposure time of the caps 2 to the sterilizing medium or the disinfecting medium, is able to be controlled by the pulse repetition frequency and/or pulse intensity of the sterilizing medium supplied in a pulsed manner to the distributor channel 9.

In order to achieve a defined position of the cap channel 5 inside the housing 6, and in this case in particular also a defined spacing between the nozzles 12 and the cap channel 5, a plurality of spacers 15 supporting the cap channel 5 are provided in the housing interior 7.

In addition to the nozzles 12 on the distributor pipe 9, there are, for example, further nozzles 16, by means of which, with the closing machine 4 in operation, the housing interior 7 can be flushed with a sterilizing or disinfecting medium and/or by means of which, during the operation of the closing machine 4, sterilizing medium is continuously brought into the housing interior 7. To remove the disinfecting or sterilizing medium, in so far as said medium is not conducted into the sterile chamber 8 of the closing machine 4, a lock is provided at the end of the transport section 1 adjacent the closing machine 4. In addition, the housing 6 is realized with inspection windows 17, through which the method of operation of the transport section 1 can be controlled and any possible faults can be ascertained.

FIGS. 4 and 5 show a simplified representation of a part length of a conveying or transport section 1*a* for closures or caps 2 with two treatment stations 18 and 19, which follow one after the other in the direction of transport A and are provided one after the other at a straight portion of the transport section 1*a* in the transport direction A. A treatment or disinfection of the caps 2 is effected, for example, in the treatment stations 18 and 19 by impinging upon the caps with a disinfecting or sterilizing medium that contains hydrogen peroxide (H2O2), for example by means of a hot gaseous and/or vaporous medium containing hydrogen peroxide in a finely dispersed or vaporized form, for example hot sterile air. The sterilizing medium is applied to the entire surface (inside and outside surfaces) of the caps 2 in the treatment station 18.

The sterilizing medium is then activated subsequently in the treatment station 19 through the application of heat for splitting oxygen radicals from the sterilizing medium or hydrogen peroxide separated at least also as condensate on the surfaces of the caps 2, in order to sterilize the caps 2 or kill off any germs. The transport section 1*a* is once again formed by a cap channel 5*a*, which, in this embodiment, consists of a top plate 20 and a bottom plate 21 as well as of a plurality of webs 22, which define the cap channel 5*a* in a lateral manner, are located between the two plates 20 and 21 that are spaced apart and are held at a spacing from said plates and from each other by means of spacing elements 23, such that the cap channel 5*a*, once again, forms a cage-like or grid-like structure that is easily accessible especially to the media used during sterilizing. The part lengths of the cap channel 5*a* represented in FIGS. 4 and 5 consist of an arc-shaped curved portion 5*a*.1 and the linear portion 5*a*.2 connecting thereto in the transport direction A, the treatment stations 18 and 19 being provided at said linear portion.

It goes without saying that the transport section 1*a* or the cap channel 5*a* are accommodated in the interior 24 of a housing 25 that is closed to the surrounding area, as is represented in a very schematic manner in FIG. 4 for the treatment stations 18 and 19. The transport of the caps 2 along the cap channel 5*a* is effected once again by means of blowing, for example using a sterile vaporous and/or gaseous medium, preferably using the treatment media also used for sterilizing the caps 2, i.e. the sterile gaseous and/or vaporous medium and the sterilizing medium that contains the hydrogen peroxide.

In detail, the conveying of the caps 2 is effected in such a manner that said caps, in the portions extending in the conveying direction A before the treatment stations 18 and 19, in particular also in the portion 5*a*.1 of the cap channel 5*a*, are conveyed by means of a gaseous and/or vaporous, sterile medium, for example by means of sterile air, it being possible for a preheating or tempering of the caps 2 to be effected at the same time by means of said gaseous and/or vaporous sterile medium, such that said caps then have a temperature or surface temperature below, for example, 70° C., for example 50° C. or approximately 50° C. with deviations of ±10° C., preferably with deviations between ±2° C.-3° C., when they enter the treatment station 18.

In the region of the treatment station 18, the conveying of the caps 2 is then effected at least in a manner supported by the hot sterilizing medium containing hydrogen peroxide that is delivered onto the caps 2 in this station. Said sterilizing medium can also be any other suitable liquid, along with $H_2O_2$ liquids that contain acetic acid or chlorine dioxide are proposed for this purpose. They can be in an aqueous mixture or in an ideal manner they are gaseous or vaporous. In the form of further constituents, inert gases or air are preferred as a gaseous mixture. In the case of a variant of the method, ionised air or a mixture of ionised air and the aforementioned substances are used as the sterilizing medium and the drive liquid.

In the region of the treatment station 19, the conveying of the caps 2 is effected at least in a manner supported by the hot sterile vaporous and/or gaseous medium that is delivered onto said caps 2 to activate the sterilizing medium or the hydrogen peroxide and to dry the caps 2. In portions of the cap channel 5*a* that connect to the portion 5*a*.2, the conveying of the caps 2 is effected with a sterile gaseous and/or vaporous medium, for example at a reduced temperature, e.g. with cooler sterile air in order to achieve, in this manner, a cooling of the treated caps 2 to a temperature that is clearly less than the treatment temperature, i.e. to a surface temperature that is clearly less than 50° C., for example to a surface temperature of 30° C. or approximately 30° C., before the caps 2 are then supplied to a closing machine or its closing tools. This cooling procedure ensures, in particular where caps are produced from plastics material, that said caps have the necessary quality in a reproducible manner, in particular also the necessary strength and mechanical stability and it is accordingly then possible during the following closing process to achieve the desired process parameters in a reliable manner, for example the necessary screw-connection torque and/or opening torque for the caps 2 that are fitted onto containers or bottles.

FIGS. 6 and 7 show different possibilities for delivering the treatment medium for conveying the caps 2 and for treating or sterilizing the caps 3 at the same time. Represented is once again the cap channel 5*a*, the plates 20 and 21 which define the cap channel at the top and at the bottom, the webs 22 and the spacer elements 23. The latter consist, in the embodiment represented in FIGS. 6 and 7, in each case of sleeve-like spacers 26-29, which are located on the identical axis as one another and are tensioned with each other and with the top plate 20 by means a bolt 20 with nut 31. The bolt 30 engages a plate-like closure element 23 by way of its bottom end for this purpose. The webs 22 provided at the spacer element 32 are tensioned between the spacers 26-29.

The spacers 26-29, as well as a further spacer 33 provided on the top side of the plate 20, form an annular channel 34, which surrounds the bolt 30 and is closed on the underside of its spacer element 23 by the closure element 32 and on the top side by a corresponding closure element 35. Nozzle openings 36 for the delivery of a gaseous and/or vaporous medium into the cap channel 5*a* are provided in each of the spacers 26-29, for example for the delivery of a medium used for the sterilizing and which at the same time also effects the conveying of the caps 2 along the cap channel 5*a*. The embodiment of the spacer elements 23 makes it possible to adjust the individual nozzle openings 36 in an individual manner by rotating the spacers 26-29 such that the use of said nozzle openings 26 achieves on the one hand, that the caps 2 moved past are impinged upon with the sterilizing medium and, on the other hand, the conveying effect is also optimized. The supplying of the treatment and/or sterilizing medium to the annular channel 34 is effected for example by means of connection openings 34.1, provided in the top spacer 33. By means of tensioning, the respective spacer element 23 is held by means of the two spacers 33 and 26 in the region of an opening on the top plate 20.

The reference 37 is also given to nozzle openings, via which, from a closed chamber formed above the plate 20, for example inside the treatment stations 18 or 19, a gaseous and/or vaporous treatment and/or sterilizing medium is delivered onto the top region of the caps 2 moved past. Similar nozzle openings 37 are also provided, for example, on the bottom plate 21 in order to impinge upon the inside surfaces of the caps moved past with the treatment and/or sterilizing medium.

The reference 38 in FIG. 7 refers to a nozzle which, similarly to the nozzles 12, consists of a pipe section 39 with a nozzle opening 40 at the end of the pipe section 39. The pipe section 39 of each nozzle 38 opens out into a chamber or channel 41, which is supplied with a pressurized gaseous and/or vaporous treatment and/or sterilizing medium during the operation of a system or transport section that includes the cap channel 5*a*.

It goes without saying that a plurality of spacer elements 23 with the nozzle openings or outlet openings 36 and/or 37 and also a plurality of nozzles 38 are provided along the cap channel 5*a* and that the cap channel 5*a* represented in FIGS. 6 and 7 too is once again accommodated in a housing that is closed in a sealed manner to the surrounding area, for example in the housing 25.

The invention has been described above by way of exemplary embodiments. Common to all these exemplary embodiments is that the at least one gaseous and/or vaporous treatment and/or sterilizing medium also serves at the same time for conveying the caps 2 along the respective transport section or cap channel 5 or 5*a*.

LIST OF REFERENCES

1, 1*a* Transport or conveying section
2 Cap
3 Supply unit
4 Closing machine
4.1 Cap transfer to the closing machine 4
5, 5*a* Cap channel
5.1-5.5 Cap channel portion
5*a*.1-5*a*.2 Cap channel portion
6 Housing
6.1-6.4 Housing portion
7 Housing interior
8 Sterile chamber of the closing machine
9 Distributor channel
10 Coupling
11 Line for supplying the treatment or sterilizing medium
12 Nozzle
13 Pipe section
14 Nozzle opening

15 Spacer
16 Nozzle
17 Inspection window
18, 19 Treatment section
20, 21 Plate
22 Web
23 Spacer element
24 Housing interior
25 Housing
26-29 Spacer
30 Bolt
31 Nut
32 End piece
33 Spacer
34 Annular channel
34.1 Connection opening
35 End piece
36 Nozzle opening
37 Opening in plate 20
38 Nozzle
39 Pipe section
40 Nozzle opening
41 Channel
A Conveying direction
STR Nozzle jet

The invention claimed is:

1. An apparatus for conveying closures for containers along a conveying direction, said apparatus comprising a first treatment section, a second treatment section, a closure channel for carrying closures through said first and second treatment sections, and a treatment station, wherein, said first treatment section is connected to a source of a first propellant, wherein, within said first treatment section, said closures are propelled by said first propellant, wherein, said second treatment section is connected to a source of a second propellant, wherein, in said second treatment section said closures are propelled by said second propellant, wherein said first propellant comprises a mixture of sterile air and sterilizing medium, and wherein said second propellant consists only of sterile air, wherein said treatment station receives closures from said closure channel, wherein said treatment station is disposed downstream of where said closures are exposed to said sterilizing medium, and wherein said treatment station is configured to expose said sterilizing medium to sufficient heat to activate said sterilizing medium by splitting oxygen radicals therefrom.

2. The apparatus of claim 1, further comprising a plurality of nozzle openings, wherein said nozzle openings are disposed within said apparatus to deliver said second propellant to said closures, wherein said nozzle openings are directed to form a jet of said second propellant, and wherein said jet is directed along said conveying direction.

3. The apparatus of claim 2, further comprising a distributor pipe that extends along at least part of said closure channel, and nozzles extending from said distributor pipe and opening into said closure channel, wherein said nozzle openings are disposed at ends of said nozzles.

4. The apparatus of claim 3, wherein said distributor pipe is disposed below said closure channel.

5. The apparatus of claim 2, further comprising webs that define lateral boundaries of said closure channel, and spacer elements that support said webs, wherein said nozzle openings are disposed adjacent to said spacer elements.

6. The apparatus of claim 5, wherein said nozzle openings comprise an adjustable nozzle opening, and wherein said adjustable nozzle opening is adjusted by rotating a spacer element to control an axial direction of a nozzle jet corresponding to said adjustable nozzle opening.

7. The apparatus of claim 2, further comprising a plate that defines one of a top and a bottom of said closure channel, wherein said nozzle openings are provided at said plate.

8. The apparatus of claim 1, further comprising a housing, and a cage, wherein said housing extends along said conveying direction and encloses at least a portion of said closure channel, wherein said cage surrounds said closure channel, and wherein said cage is disposed within said housing.

9. The apparatus of claim 8, further comprising webs that define lateral boundaries of said closure channel, wherein said webs guide said closures with play, and wherein said webs are configured to enable said sterilizing medium to reach said closures by passing through said lateral boundaries.

10. The apparatus of claim 8, further comprising webs that define boundaries of said closure channel, wherein said webs guide said closures with play, and wherein said webs are configured to enable said sterilizing medium to reach said closures by passing through said boundaries.

11. The apparatus of claim 8, wherein said closure channel comprises a plurality of closure channel portions that connect together in a conveying direction, said plurality of closure channel portions comprising a first portion, a second portion downstream from said first portion, and a third portion downstream from said third portion, wherein closures in said first portion are conveyed only by gravitational force, wherein closures in said second portion are conveyed by said second propellant, wherein closures in said third portion are conveyed only by gravitational force, wherein said first portion receives closures provided by a supply unit, and wherein said third portion connects to a closing machine that is configured to close containers with said closures.

12. The apparatus of claim 1, wherein said closures are propelled by pulses of at least one of said first propellant and said second propellant.

13. The apparatus of claim 1, wherein, in said treatment station, said closures are exposed to a hot gaseous medium.

14. The apparatus of claim 1, wherein said closure channel comprises a first portion and a second portion, and wherein along a selected said of said closure channel, said closures are conveyed only by gravity, wherein said selected portion is selected from the group consisting of said first portion and said second portion.

15. The apparatus of claim 14, wherein said first portion is longer than said second portion.

16. The apparatus of claim 1, further comprising a supply unit and a closing machine, wherein said supply unit comprises a hopper for accommodating said closures, wherein said closing machine is configured to close containers with said closures, and wherein said closure channel extends between said supply unit and said closing machine.

17. The apparatus of claim 1, wherein said sterilizing medium comprises hydrogen peroxide.

18. The apparatus of claim 1, wherein said second treatment section is disposed downstream of said first treatment section.

19. An apparatus for conveying closures for containers along a conveying direction, said apparatus comprising a first treatment section, a second treatment section, and a closure channel for carrying closures through said first and second treatment sections, wherein, said first treatment section is connected to a source of a first propellant, wherein, within said first treatment section, said closures are propelled by said first propellant, wherein, said second treatment section is connected to a source of a second propellant, wherein, in said second treatment section said closures are propelled by said second propellant, wherein said first propellant comprises a mixture of sterile air and sterilizing medium, and wherein said second propellant consists only of sterile air, wherein said closures are propelled by pulses of at least one of said first propellant and said second propellant.

20. The apparatus of claim 19, further comprising a plurality of nozzle openings, wherein said nozzle openings are disposed within said apparatus to deliver said second propellant to said closures, wherein said nozzle openings are directed to form a jet of said second propellant, and wherein said jet is directed along said conveying direction.

* * * * *